US006319547B1

(12) United States Patent
Li

(10) Patent No.: US 6,319,547 B1
(45) Date of Patent: Nov. 20, 2001

(54) BUTTON THREAD STRENGTHENER AND METHOD

(76) Inventor: Victor F. Li, 4040 Moraga Ave., San Diego, CA (US) 92117

( * ) Notice: Subject to any disclaimer, the term of this patent is extended or adjusted under 35 U.S.C. 154(b) by 0 days.

(21) Appl. No.: 09/558,240

(22) Filed: Apr. 24, 2000

(51) Int. Cl.[7] ..... B05D 3/00
(52) U.S. Cl. ..... 427/140; 427/389.9; 427/394
(58) Field of Search ..... 427/140, 142, 427/389.9, 394

(56) References Cited

U.S. PATENT DOCUMENTS

| | | | | |
|---|---|---|---|---|
| 2,451,077 | | 10/1948 | Emsig | 24/90 |
| 3,816,200 | | 6/1974 | McKenna | 156/93 |
| 4,120,054 | * | 10/1978 | Lemelson | 2/265 |
| 4,823,948 | | 4/1989 | Bonar | 206/227 |
| 5,409,740 | * | 4/1995 | Brann | 427/413 |
| 5,824,413 | | 10/1998 | Schell | 428/378 |

FOREIGN PATENT DOCUMENTS

| | | | |
|---|---|---|---|
| 2841442 | * | 4/1980 | (DE) . |
| 22561437 | * | 7/1992 | (GB) . |
| WO98/ 08777 | | 3/1998 | (WO) . |

OTHER PUBLICATIONS

Plastic News, USA, 6, No. 11, p 38, May 1994.*

* cited by examiner

*Primary Examiner*—Erma Cameron
(74) *Attorney, Agent, or Firm*—Frank G. Morkunas

(57) ABSTRACT

A method of strengthening threads holding an article, such as a button, onto a fabric substrate by applying a bonding solution onto a damaged thread bundle holding the article onto the substrate; ensuring penetration of the bonding solution such that the bonding solution coats all thread strands of the damaged thread bundle from top to bottom including thread strands sewn into the fabric substrate to thereby form a coated thread bundle; and curing the coated thread bundle to form an aggregate stem which is stronger than the original thread bundle and more securely holds the article onto the fabric substrate. The properties of the bonding solution to perform in the manner stated require that it be a low-VOC, water-based urethane, water-based acrylic, or water-based urethane-acrylic being a single-component, non-catalyzed, solution further having non-ambering and heat- and water-resistant qualities after curing.

3 Claims, 1 Drawing Sheet

BUTTON THREAD STRENGTHENER AND METHOD

CROSS REFERENCES TO RELATED APPLICATIONS

Not applicable.

STATEMENT REGARDING FEDERALLY-SPONSORED RESEARCH OR DEVELOPMENT

Not applicable.

BACKGROUND OF THE INVENTION

The present invention relates to an improvement in button thread strengtheners and their applications to the threads, new or old, in the process of affixing buttons to base fabric; the buttons and threads serving as fasteners for garments or other applications. More specifically, the invention relates to the problem of prolonging functionality and anchoring against loss of buttons which are weakly affixed, by weakened or damaged threads, to the base fabric.

It cannot be denied that society's pace today has multiplied exponentially in a few short years over what it was before with the advent of instant communication throughout the world in the form of cellular phone proliferation and the Internet. The business pace is frantic. Growth seems unstoppable. Meetings, business or semi-social, abound to continuously fuel this growth. Any advantage one may garner over any potential competitor is critical. Appearance at important meetings weighs in heavily as a potential advantage. How often, and unexpectedly, does it occur that, immediately prior to an important meeting, after conducting a last-minute of one's appearance, does that person notice a loosely hanging button; with its ultimate detachment from the garment [shirt, pants, jacket, suit, etc.] imminent. Whether loose or missing, the appearance quotient has been undermined.

A person in this situation is strapped for time; time better spent on last-minute preparations for the important meeting. Time now must be expended on button repair in the form of sewing in strengthening threads or seeking a replacement garment. There have been no 'quick fixes' to this scenario which, undoubtedly, plays out regularly on a daily basis. One prior art patent in particular relates to button bonding (McKenna Pat. No. 3,816,200) and another relates to strengthening and/or coating fibers (Girgis WO 98/08777).

McKenna on the one hand provides for bonding the surface of the button, before, a need exists. McKenna clearly points out that application of bonding agents are to be applied only to the button surface, not allowing the agent to wet the newly-sewn thread bundle or to penetrate below the surface such that, should the agent penetrate below the surface, the flexibility of the button would be adversely affected. McKenna teaches a protective capping and bonding of the thread portions crossing the face of the button. The bonding agent in McKenna is selected to have a controlled degree of penetrability on the specific thread being used such that penetration of the bonding agent into the threads will be limited to substantially the region of application of the bonding agent and not below the surface.

Girgis, on the other hand, teaches the application of bonding agents/liquids to fiber strands (coated fiber strands, composites and assemblies, and the like) while in the manufacture process and, in particular, for industrial purposes and uses. More particularly, Girgis addresses new manufacture of machinery elements (hoses) for industrial application and not for consumer application and clearly not for garments or button threads thereon. Moreover, the Girgis process is extremely complex and requires a good deal of surface preparation to ensure proper bonding. In this regard, all fibers and materials must be pre-coated or primed with other specific substances. The Girgis invention provides for an aqueous secondary coating composition adapted to coat a fiber strand having thereon a primary layer of sizing composition which is different from the secondary coating composition. Girgis details the manufacture process which requires a relatively 'clean' and pre-treated state for the process to work properly and as intended. The Girgis invention does not, and cannot, apply to strengthening fibers in the post-manufacture use, unclean, and weakened state; i.e., loose thread or threads on buttons.

My invention, unlike all prior art inventions, entails application to a weakened, button-holding, thread while that thread is still in use, such that the thread, from top to bottom, is strengthened immediately and the button retained in place on the garment. The invention is a fast-acting, long-lasting, thread bonding composition. It is non-flammable, has minimal odor, enjoys an EPA rating for Health of 0, and has a long shelf-life. It dries and cures to a relatively colorless (non-ambering) hardened state to preserve the aesthetics of the garment. After curing, the material is tough and durable, capable of withstanding repeated washing and hot drying cycles with minimal loss of strength. In application, by capillary action, it wets the threads of the tread-button assembly, from the button to the base fabric, while also wetting the threads contacting the button and, in the process, additionally wetting the base fabric immediately adjacent the threads. By surface tension, the solution draws the separate threads of the thread bundle together as it dries and cures, thereby forming a single, bonded-thread shank (or thread bundle) to thereafter securely hold the button to the base fabric. None of the prior art is suited to this purpose and manner of application.

Accordingly, several objects and advantages of my invention are to:

a. provide an easy and convenient 'mending' of weakly attached or loose buttons on garments;
b. provide a quick and durable mend of weakly attached or loose buttons on garments;
c. permit repeated use of the solution based on its extended shelf-life;
d. not interfere with the aesthetics of a garment and threads to which the solution is applied by virtue of its non-ambering properties; and
e. make available to the public an economical and trouble-free button mender.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The above-noted problems, among others, are overcome by the present invention. Briefly stated, the present invention contemplates a method of strengthening threads holding an article, such as a button, onto a base fabric or fabric substrate by applying a bonding solution onto a damaged (or undamaged) thread bundle holding the article onto the substrate; ensuring penetration of the bonding solution such that the bonding solution coats all thread strands of the thread bundle from button to base fabric including the thread strands sewn into the fabric substrate to thereby form a coated thread bundle and well-penetrated thread bundle; and curing the coated thread bundle to form an aggregate stem which is stronger than the original thread bundle and more securely holds the article onto the fabric substrate. The properties of the bonding solution to perform in the manner stated require that it be a low-VOC, water-based, urethane or water-based acrylic or water-based urethane-acrylic being a single-component, non-catalyzed, solution further having non-ambering and heat- and water-resistant qualities after curing. Low-VOC is suited for fire safety, health, and environmental safety reason; being water-based provides for proper capillary action and surface tension; the urethane or acrylic or urethane-acrylic component provides for physical, chemical, and mechanical properties such as strength, water- and heat-resistance, color, adherence to contaminated or damaged thread, and the like; being a single component provides for convenience and ease of use; being non-catalyzed also provides for convenience and contributes to a long shelf-life; having a non-ambering attribute contributes to the aesthetics of a cured product (i.e., the cured and strengthened thread bundle does not convey a yellow-ish appearance which, if it were yellow-ish, may contrast with the fabric color scheme).

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF THE INVENTION

Threads in garments are no stronger than their weakest point. When threads do not transfer loads to one another, the strength of a thread bundle (one or more thread strands in close proximity to one or more thread strands) is less than the sum of the strengths at the weakest point of each thread. Bonded threads transfer loads to one another. This enables the load at the weakest point of a particular thread to be carried by the stronger regions of other threads. Since the weakest points of thread bundles are somewhat randomly distributed, it is highly unlikely that all weakest points will all occur together. Thus, the strength of a bonded, composite thread bundle is about the average short-length thread strength multiplied by the number of threads. Bonding threads with a unique thread/fiber binder and manner of use stands as the focus of my invention.

Through extensive experimentation with many products and solutions, I have found that properly bonded threads are generally much stronger than unbonded threads (be these unbonded threads damaged or undamaged). The reason for this is explained above. My invention not only strengthens an undamaged thread bundle (full complement of undamaged threads passing through a provided buttonhole or buttonholes for the purpose which pierce [s] a button), it makes it into a single load-carrying shank or stem stronger than the original thread bundle. A damaged thread bundle has limited button-retaining capacities. The greater the damage, the less retention capacity. The damaged, pre-bonded threads (be they old, worn, frayed, or broken), however, to the extent to which they are still intact, provide the structural scaffold upon which the newly bonded thread bundle, after application and curing, is formed (much in the fashion that the wick in an old-fashioned, dipped candle provides the support for the wax). In this invention, however, the cured strengthener (cured thread bundle 15") is typically much stronger than the original threads and concomitant thread bundle.

Briefly stated, my invention envisions the application of a suitable solution to a damaged thread bundle—a solution which, through years of experimentation, I have discovered bears the necessary properties necessary to function in the manner desired yielding superior results. After application of the solution, the solution wets and coats all threads in the bundle, from the bottom to the fabric substrate, including the small proximal region of the fabric substrate into which the respective threads are sewn. The solution is such that, by capillary action, it penetrates and wets these threads, the base fabric of the garment, and all thread-button interstices. By such action, the button threads are drawn or merged, by surface tension, into a single aggregate or stem. The solution dries, cures, and bonds. After such curing, all thread surfaces, including thread surfaces in the underlying garment fabric are bonded together into a single, strengthened, stem.

Figure 1:
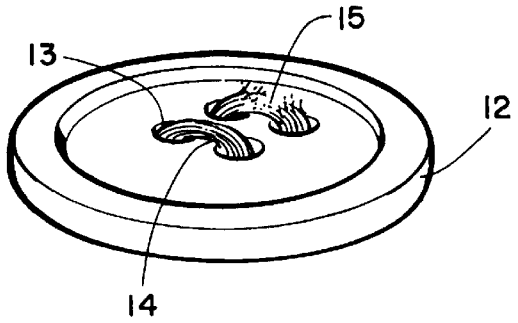
FIG. 1 is a perspective view of a button with threads.
Figure 2:
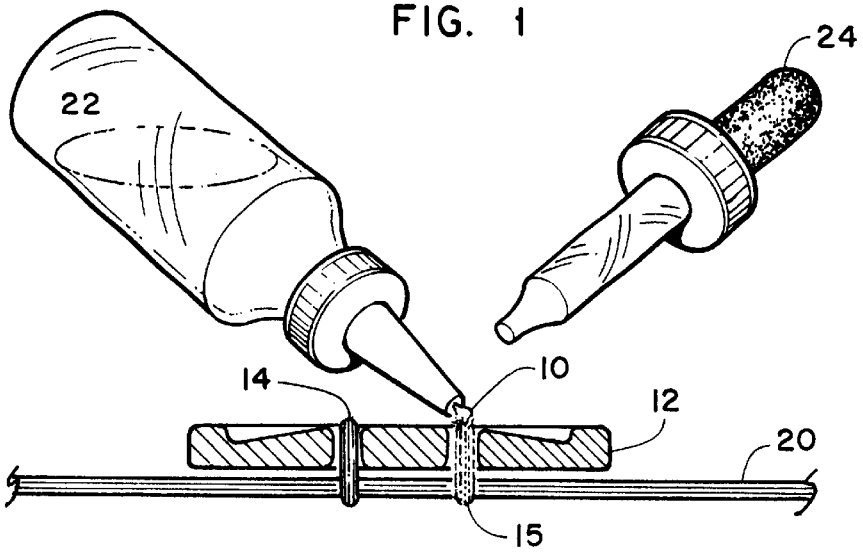
FIG. 2 is a cross-sectional view of a button attached to a garment during the coating process.

Reference is now made to the drawings and in particular to FIGS. 1 through 4. Reference character 12 is a button having one or more buttonholes 13. A full thread bundle 14 (undamaged thread bundle) fully secures the button to a fabric or garment 20. A partial thread bundle 15 (damaged thread bundle) loosely holds the button 12 onto the garment 20. When a damaged thread bundle 15 is detected, a user should obtain a urethane, a urethane-acrylic, or an acrylic solution 10 bearing the properties, as to be described below, and apply an appropriate amount (generally one but sometimes more drops) onto the damaged thread bundle 15. As illustrated in FIG. 2, application may be by a squeeze-bottle with a dropper tip (represented as reference numeral 22), by an eye dropper 24, or any similar application device or mode provided such device or mode is capable of containing the solution 10 and dispensing the solution 10, in a controllable fashion, onto a thread bundle (damaged 15 or undamaged 14) to thereby wet the respective thread bundle adequately, but not excessively, (as illustrated in FIG. 2, the application is being applied to the damaged thread bundle 15—in this state the damaged thread bundle has not yet been wetted).

Figure 3:
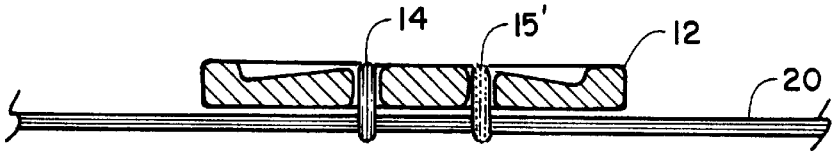
FIG. 3 is a cross-sectional view of a button attached to garment.
Figure 4:
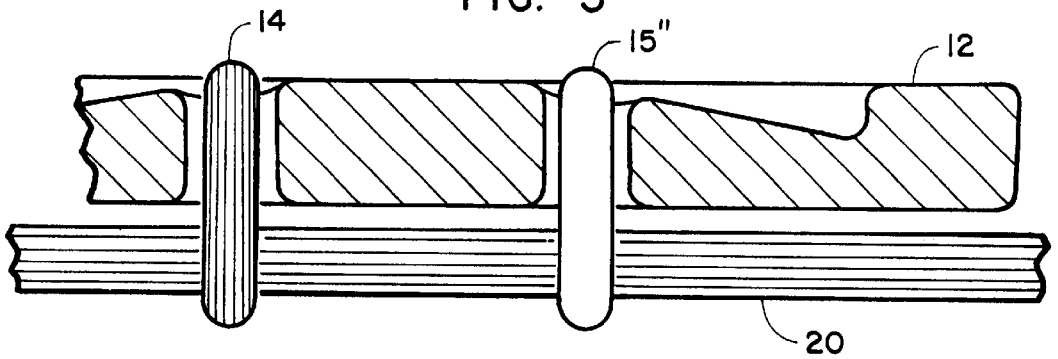
FIG. 4 is a cross-sectional view of a button attached to a garment during the curing phase.

After the thread bundle 15 is wetted, further application is ceased and the user waits for the solution 10 to fully coat the damaged thread bundle and waits for the coated thread bundle to dry and to cure. FIG. 3 illustrates a coated thread bundle 15' after having been wetted and coated by the solution 10. FIG. 4 illustrates the cured thread bundle 15" after the solution 10 has set and cured thereby bonding the threads of the damaged thread bundle into a bonded stem from top to bottom including the underlying garment portion into which the threads had been sewn.

As noted above, the solution permeates, wets, and coats the individual threads of the damaged thread bundle 15 and the underlying garment fibers through which the threads pass thereby forming a coated thread bundle 15' comprising the individual threads and the underlying garment fibers. During the coating phase, the coated thread bundle 15' has drawn together the individual threads into a single aggregate. As the coated thread bundle 15' dries and cures, the individual threads are coalesced or bonded onto each other and to the underlying garment fibers thereby forming a cured or strengthened thread bundle 15". This cured thread bundle 15" bears qualities greater than the full thread bundle 14 and greater than the sum of the individual threads forming the original damaged thread bundle 15. Based on the properties of the solution, as to be described below, cure time ranges from between about two to four hours.

After using the solution 10, the applicator should be capped to preserve the solution 10 therein. Given the properties of the solutions I have discovered which function suitable for thread strengthening, a shelf-life of in excess of two years.

For this process to properly function, the solution which is ideal for such purposes should be (1) water-based; (2) of a low volatile organic compound (VOC); (3) of a single-component; (4) non-catalyzed; (5) non-ambering; and (6) heat and water resistant after curing. Any urethane; acrylic; or combination urethane/acrylic paints (hereafter for administrative economy, and unless otherwise stated, all three types will be collectively referred to as urethane) bearing these properties will suffice as an overall bonding agent solution 10. It is the resins contained within these urethanes which react to form the necessary bond.

As such, this solution is an emulsion consisting of a colloidal suspension of urethane resin and other result-enhancing additives in a water base. The urethane properties, in proper proportion, provide the necessary bonding effect; the water properties, in proper proportion, provide the wetting effect, penetration effect, and, by capillary action, the drawing or merging effect of the threads and strands to each other. All threads and strands which are loose, frayed, weakened, or unchanged, are so drawn together to form one aggregate strand or stem-like structure; albeit, in this state, in liquid-coated form (the coated thread bundle 15'). The water base is drawn into and around the threads and fibers. It coats and draws with it the resins. As the water evaporates and the resin dries and cures, the thread bundle aggregate is bonded into a thread bundle aggregate 15" which includes all threads in the bundle and a portion of the fabric in the garment through which those threads pass. This newly bonded or cured thread bundle 15" bears a higher tensile strength relative to the underlying threads and fibers upon which this cured thread bundle 15" is based.

The entire process basically involves an aqueous phase; and emulsion phase; and a surfactant substance phase. The aqueous phase (the water content) provides the surface tension to drive strong capillary action; to aggressively wet, permeate, and coat most common materials which are used in textiles; to draw loose, frayed, old, ruptured threads together into one aggregate strand or stem (creation of the coated thread bundle 15' ); and, during its motions and action, to draw along into, and become part of the coated thread bundle 15', the resins. The emulsion phase is also the dispersal phase; i.e., the urethane content and resin stabilized together in emulsion form by the surfactant phase (surfactant substances with high vapor pressures exhibiting both hydrophobic and hydrophilic properties suited for this purpose are found in the following commercially available products: ENDURO WAT-R-BASE POLY; PRO FINISHER POLYURETHANE; and UA-15)

The aqueous phase performs the function of distributing the resinous materials over the surfaces and interstices of the button threads and into the pores of the threads, if any (thread bundle to include threads woven into the fabric of the garment), to the extent that the material of the threads are coated, wetted, and saturated. This phase simultaneously performs the function of drawing the threads and fibers together into a single aggregate or stem (coated thread bundle 15') even as the aggregate is diminished in volume by evaporation of the water. The resins coalesce and cure on this aggregate as the water evaporates. After evaporation of the water, and complete curing of the resin, the new thread bundle (cured thread bundle 15") is stronger then its underlying original thread bundle 15.

Urethanes suited for the intended purpose include, but are not limited to, ENDURO WAT-R-BASE POLY manufactured by Compliant Spray Systems; PRO FINISHER POLYURETHANE manufactured by Parks; and UA-15 manufactured by Triarch. It must be understood, however, that other urethanes suited for the intended purposes may be used provided they bear the properties and qualities set forth above. What is unique to the urethanes mentioned above is the ratios of water, urethane, and VOC's. In this regard, I have found urethanes suited for the intended purpose should be between about 44% to 64% water; have a content of about 22% to 44% urethane (i.e., urethane or acrylic or urethane-acrylic each containing a resin), and a VOC content of about 1% to 19%. The best formulation to more properly function and produce the desired result, however, would be about 54% water; about 32.2% urethane (i.e., urethane or acrylic or urethane-acrylic each containing a resin); and about 13.6% VOC.

The present disclosure includes that contained in the present claims as well as that of the foregoing description. Although this invention has been described in its preferred form with a certain degree of particularity, it is understood that the present disclosure of the preferred form has been made only by way of example and numerous changes in the details of construction and combination and arrangement of parts and method steps may be resorted to without departing from the spirit and scope of the invention. Accordingly, the scope of the invention should be determined not by the embodiment [s] illustrated, but by the appended claims and their legal equivalents.

The invention claimed is:

1. A method of strengthening damaged threads holding an article onto a fabric substrate comprising the steps of:

applying a bonding solution onto a damaged thread bundle holding the article onto the substrate, said bonding solution selected from a group consisting of water-based urethanes, water-based acrylics, or water-based urethane=acrylics, wherein said bonding solution further comprises a volatile organic compound (VOC) component not exceeding approximately 19% in volume of the entire bonding solution and a water-content component of between approximately 44% and approximately 64% in volume of the entire bonding solution;

ensuring penetration of said bonding solution such that said bonding solution coats all thread strands of said damaged thread bundle from top to bottom including thread strands sewn into the fabric substrate thereby forming a coated thread bundle; and curing by allowing said bonding solution on said coated thread bundle to dry thereby forming an aggregate stem; whereby said aggregate stem more securely holds the article onto the fabric substrate.

2. The method as defined in claim 1 wherein said bonding solution comprises a single-component non-catalyzed bonding solution.

3. The method as defined in claim 1 wherein said bonding solution has post-cured non-ambering properties.

* * * * *